US005497839A

United States Patent [19]

Moir

[11] Patent Number: 5,497,839

[45] Date of Patent: Mar. 12, 1996

[54] LIQUID-DRIVEN DOWNHOLE HAMMER DRILL

[75] Inventor: Fredrich G. Moir, Melrose Park, Australia

[73] Assignee: SDS Pty Ltd., Melrose Park, Australia

[21] Appl. No.: 307,848

[22] PCT Filed: Mar. 31, 1993

[86] PCT No.: PCT/AU93/00135

§ 371 Date: Dec. 16, 1994

§ 102(e) Date: Dec. 16, 1994

[87] PCT Pub. No.: WO93/20322

PCT Pub. Date: Oct. 14, 1993

[30] Foreign Application Priority Data

Apr. 1, 1992 [AU] Australia ..... PL1641

[51] Int. Cl.[6] ..... E21B 4/14; E21B 21/12

[52] U.S. Cl. ..... 175/65; 175/92; 175/215; 175/217; 175/218; 175/296

[58] Field of Search ..... 175/296, 297, 175/215, 92, 417, 418, 65, 217, 218

[56] References Cited

U.S. PATENT DOCUMENTS

| | | | |
|---|---|---|---|
| 3,175,628 | 3/1965 | Dellinger | 175/215 X |
| 3,268,017 | 8/1966 | Yarbrough | 175/215 X |
| 3,491,838 | 1/1990 | Wilder et al. | 173/73 |
| 3,568,783 | 3/1971 | Chenoweth et al. | 175/296 X |
| 3,596,720 | 8/1971 | Elenburg | 175/215 X |
| 3,970,152 | 6/1976 | Harris et al. | 173/15 |
| 4,819,746 | 4/1989 | Brown et al. | 175/296 |

FOREIGN PATENT DOCUMENTS

| | | |
|---|---|---|
| 89/00638 | 1/1989 | WIPO . |
| 92/01138 | 1/1992 | WIPO . |

*Primary Examiner*—Stephen J. Novosad
*Attorney, Agent, or Firm*—Michael N. Meller

[57] ABSTRACT

A drill stem arrangement and method in which the motor for providing the hammer action is in the drill stem near to the drill bit. The motor is driven by pressurised liquid and a proportion of the liquid is used for flushing drill cuttings and cooling the drill bit.

15 Claims, 6 Drawing Sheets

LIQUID-DRIVEN DOWNHOLE HAMMER DRILL

Figure 1:
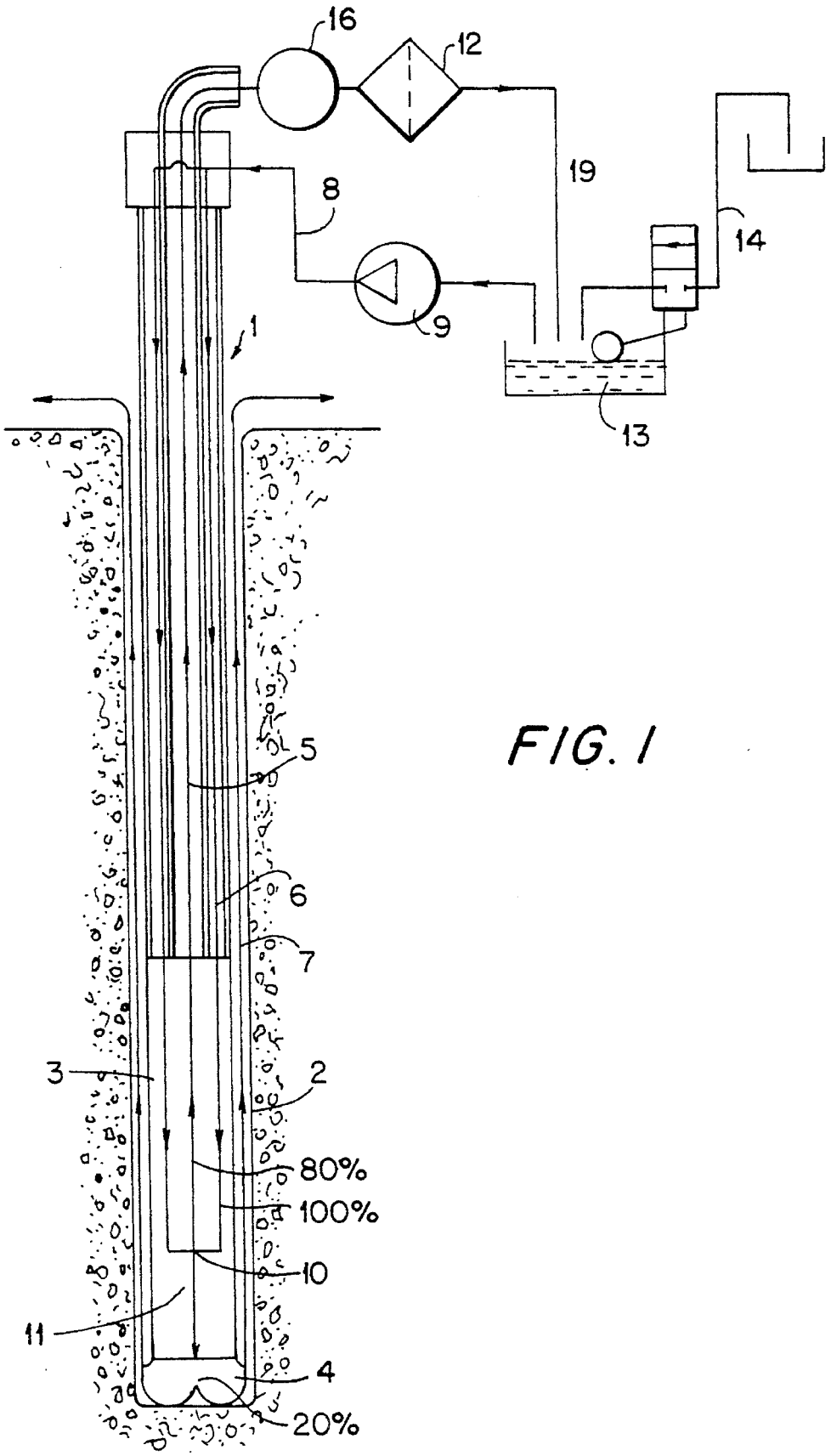

This invention relates to a drilling means, arrangement and method.

It is presently conventional to have a drill stem at the end of which is a drill bit which is being intermittently impacted to effect a cutting of the presented face from which cuttings are flushed by a flow of air. Such arrangements when used down a mine require a large compressor at the surface providing pressurised air via pipes to a boosting compressors down the mine. This is relatively inefficient and expensive due to the lengths of pipes and number of compressors required. Alternatively, this cost can be reduced by removing the boosting compressor and thereby using lower pressure air at the expense of a decreased drilling rate.

When using high pressure air drills they can be dangerous if a break or rupture occurs in the pipes or hoses which feed the drill stem from the compressor. If there is such a break or rupture it is possible that the pipe will have a whip action caused by the high pressures flowing therethrough, therefore this is dangerous and may result in injuries or loss of life.

A further disadvantage is that high pressure air drills can cause a significant amount of dust to be created causing discomfort or health problems to personnel involved in the drilling. In addition, drilling with high pressure air is extremely noisy causing further safety and discomfort problems.

Another disadvantage of high air pressure systems is that cuttings are generally flushed, or removed, by pressurised air flowing over or near the drill bit and along the outside of the drill stem. However, due to the high air velocity involved there can be a significant wearing of the outside of the drill stem due to the abrasive nature of the cuttings when forced along the outside of the stem.

Due to the above problems associated with air pressure drill systems it is preferable to drive the impacting hammers with liquids at high pressures. There are two known methods of drilling with high pressure liquids these are: top hole hydraulic hammer (the hammering mechanism is located at the top of the drill stem away from the bit and is powered by pressurised hydraulic oil); down the hole liquid hammer (the hammering mechanism located immediately behind the drill bit at the bottom of the stem and is powered by pressurised liquid).

The top hole hydraulic hammer transmits the hammering action from the top of the drill stem, therefore there is a cyclic strain upon the total length of the drill stem. Consequently, the drill stem has to be strong and therefore it is substantially more expensive than other drill stems. Other factors which increase the cost of top hole hydraulic hammers are due to the expensive top hole hydraulic hammer. Furthermore, this type of drilling is inaccurate compared to both air and liquid down the hole drilling.

To our knowledge current down the hole liquid hammers have been developed to work upwards only, that is the drill bit is physically above the hammering mechanism and the rest of the drill stem. In such systems all of the liquid is flushed out of at the end of the drill bit that is the flushing liquid and cuttings flow out of the hole by the effects of gravity and the liquid is not re-used. Consequently, vast amounts of liquid are required to operate such drills and there are problems associated with removal of this liquid (especially when drilling down a mine).

It is the intended object of this invention to alleviate one or more of the above problems or at least provide the public with a useful alternative to currently used drilling methods, means or arrangements.

According to one form this invention there is provided an arrangement in which there is a down the hole hammer adapted to be driven by a liquid. A feature of this arrangement however which allows this to be generally considered to be feasible is that there are means such that, of the water at pressure used to drive the down the hole hammer, there are means to divert a proportion only of such water for the flushing of cuttings.

According to another form of this invention there is provided a drilling means including:

a drill stem having a cutting end and a liquid supplying end;

a liquid supply passage in the drill stem;

a liquid return passage in the drill stem;

a drill bit at the cutting end of the drill stem; and a hammer motor located in the drill stem such that its distance from the cutting end is less than its distance from the liquid supplying end, the hammer motor being in mechanical communication with the drill bit such that the hammer motor provides a hammer action to the drill bit, the hammer motor being adapted to provide the hammer action due to pressurised liquid supplied along the liquid supply passage to the hammer motor, the liquid then being returned along the liquid return passage.

In preference, the hammer motor has a hammer piston and the location of the hammer motor within the drill stem is such that the hammer piston directly hammers against the drill bit.

This location of the hammer motor has the advantage of increased drilling accuracy (especially for long drill stems). Furthermore, the liquid return passage provides a means of re-using the water.

In preference, there is a liquid flushing passage in communication with the liquid return passage, the liquid flushing passage being adapted to divert a proportion of the liquid away from the liquid return passage and out of the drill stem at or near the cutting face of the drill bit. This diverted proportion of the liquid is used for flushing and removal of cuttings.

In preference, the drilling means has an adjustable flow control valve in the liquid return passage, the adjustable flow control valve being adapted to divert the proportion of liquid away from the liquid return passage to the liquid flushing passage.

In preference, adjustable flow control valve is located outside of the drill stem in a liquid return line which is in communication with the liquid return passage, wherein the adjustment of the flow control valve varies the flow of liquid along the liquid return passage.

In experiments conducted thus far, 20% of the liquid being returned from the hammer motor is preferably diverted to the liquid flushing passage.

Alternatively, according to another form of this invention there is provided a drilling arrangement including:

a drill stem having a cutting end and a liquid supplying end;

a liquid supply passage in the drill stem;

a liquid return passage in the drill stem;

a drill bit at the cutting end of the drill stem;

a liquid storage means for storing liquid;

a pressurising and supplying means for pressurising the liquid and supplying the liquid to the liquid supply passage;

a hammer motor located in the drill stem such that its distance from the cutting end is less than its distance from the liquid supplying end, the hammer motor being in mechanical communication with the drill bit such that the hammer motor provides a hammer action to the drill bit, the hammer motor being adapted to provide the hammer action due to pressurised liquid supplied along the liquid supply passage to the hammer motor, the liquid then being returned along the liquid return passage.

The majority or all of the liquid can be simply recirculated so that finding a vast supply of water or liquid is not simply necessary.

In preference, the hammer motor has a hammer piston and the location of the hammer motor within the drill stem is such that the hammer piston directly hammers against the drill bit.

In preference, there is a liquid flushing passage in communication with the liquid return passage, the liquid flushing passage being adapted to divert a proportion of the liquid away from the liquid return passage and out of the drill stem at or near the cutting face of the drill bit. This diverted proportion of the liquid is used for flushing and removal of cuttings.

In preference, the drilling means has an adjustable flow control valve in the liquid return passage, the adjustable flow control valve being adapted to divert the proportion of liquid away from the liquid return passage to the liquid flushing passage.

In preference, adjustable flow control valve is located outside of the drill stem in a liquid return line which is in communication with the liquid return passage, wherein the adjustment of the flow control valve varies the flow of liquid along the liquid return passage.

Alternatively, according to another form of this invention there is provided a method of drilling including the steps of:

directing pressurised liquid through an appropriately arranged drill stem to a hammer motor;

providing a drilling action to a drill bit at the end of the drill stem, the drilling action resulting from the effects of the pressurised liquid upon the hammer motor;

returning par of the liquid by a path past the cutting face of the drill bit to flush cuttings resulting from the drilling action; and directing the rest of the liquid by a path back up the drill stem to a separate collection station.

Alternatively, according to another form of this invention there is provided a method of drilling including the steps of:

supplying a pressurised liquid down a drill stem to a hammer motor located within the drill stem;

providing a hammer action resulting from the effects of the supplying of the pressurised liquid to the hammer motor;

effecting a drilling action of a drill bit located at the drilling end of the drill bit, the drilling action resulting from the hammer action;

directing the liquid supplied to the hammer motor up the drill stem through a return passage in the drill stem.

In preference, the method is further characterised by step of effecting of the drilling action being the result of the hammer motor hammering against the drill bit.

In preference, the method is further characterised by the step of diverting a proportion of the liquid away from the return passage and to the face of the drill bit.

In preference, the step of diverting is further characterised in that the proportion diverted is less than the proportion flowing along the return passage.

In preference, the diverting step is further characterised by approximately 20% of the liquid is diverted to the face of the drill bit.

In prefence, the method is further characterised by the drilling being in a substantially downward direction such that the drill bit is physically below the hammer motor and the rest of the drill stem.

Figure 2:
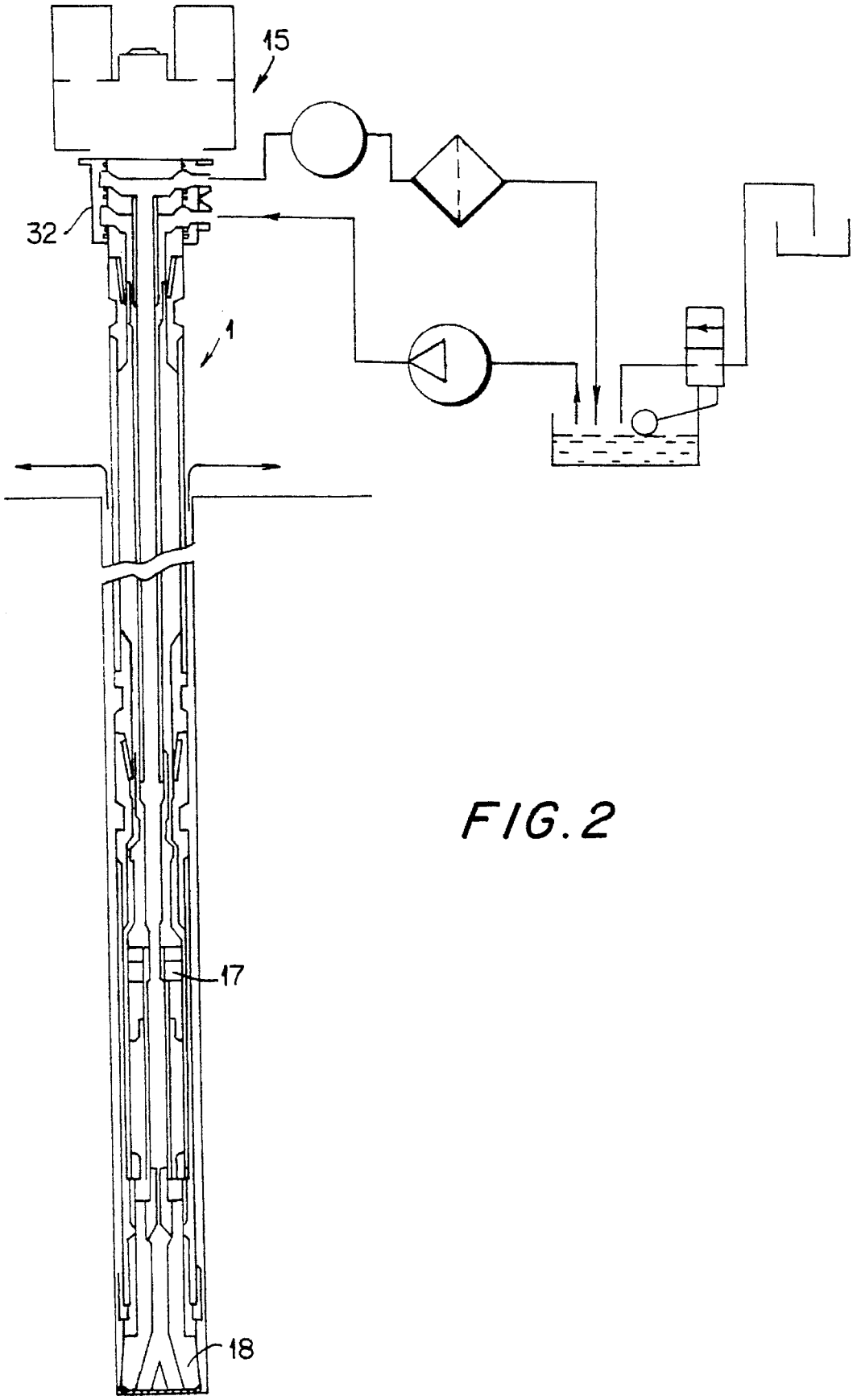
Figure 3:
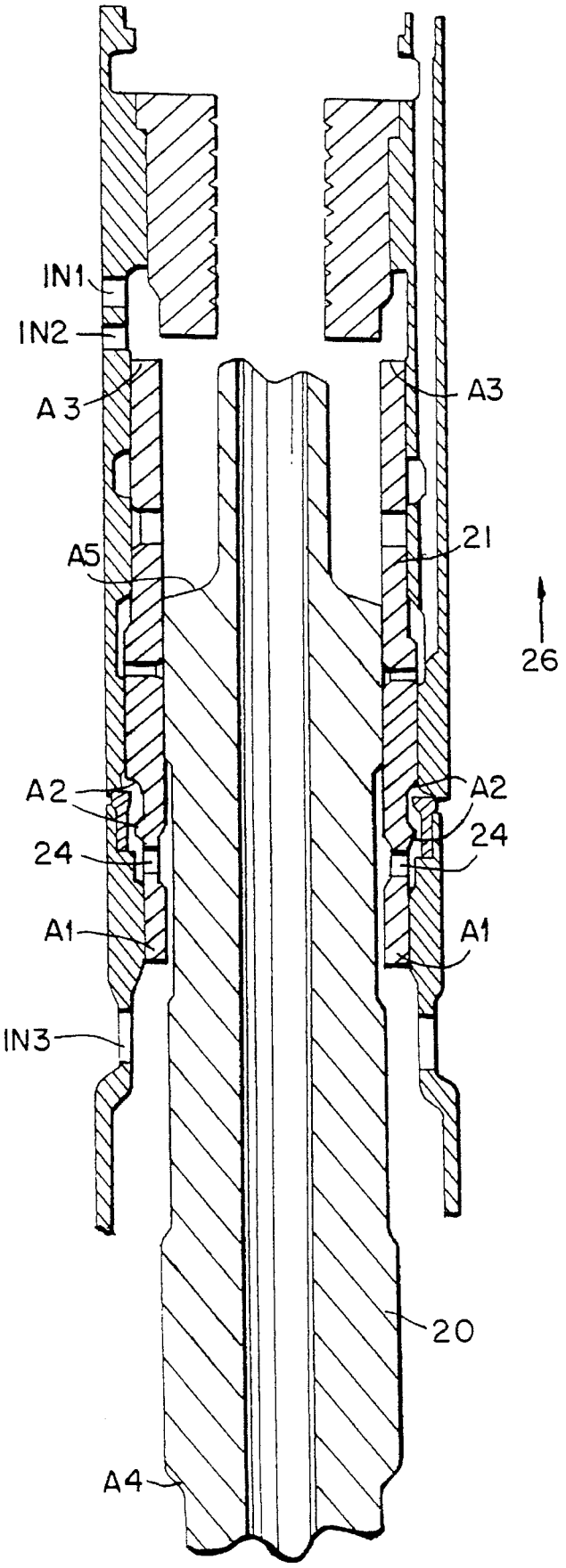
Figure 4:
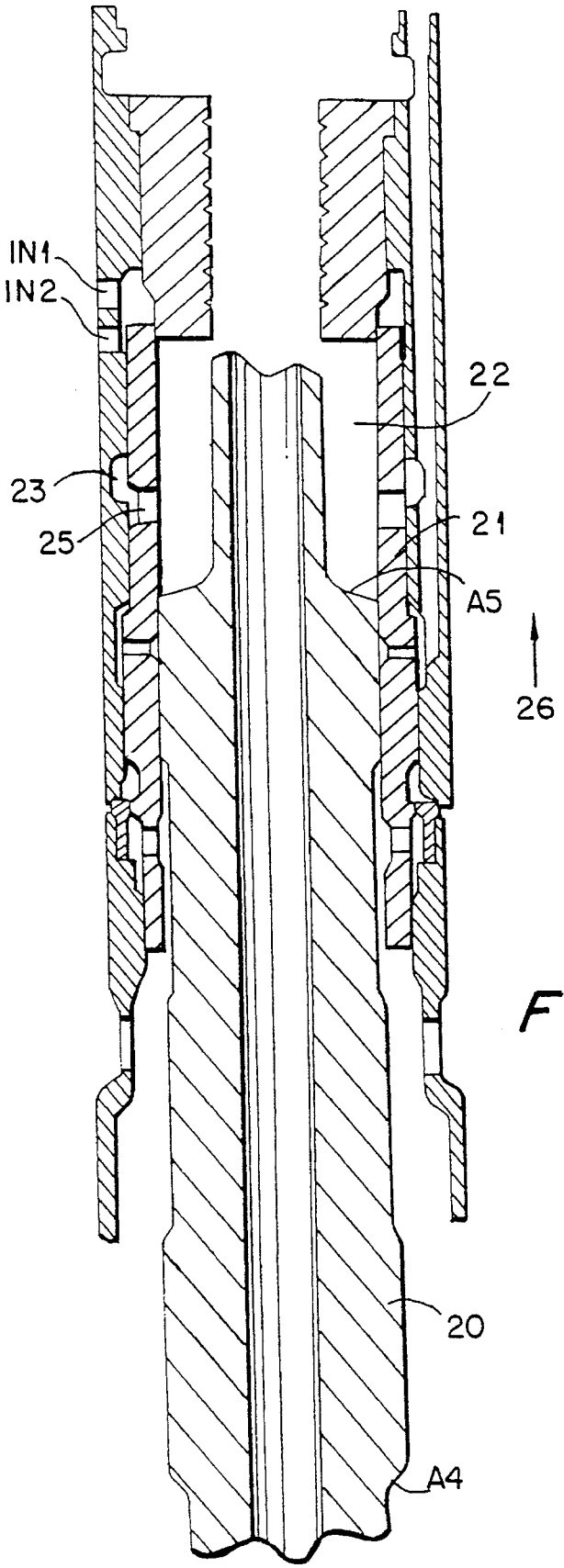
Figure 5:
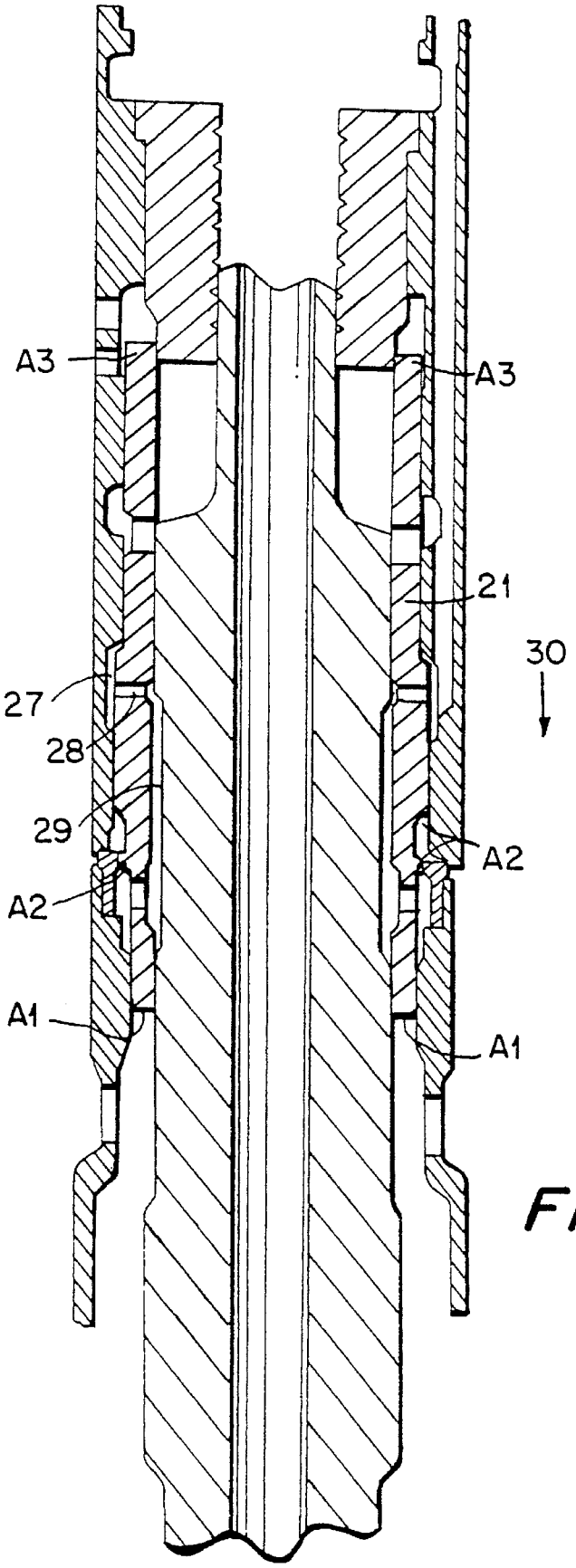
Figure 6:
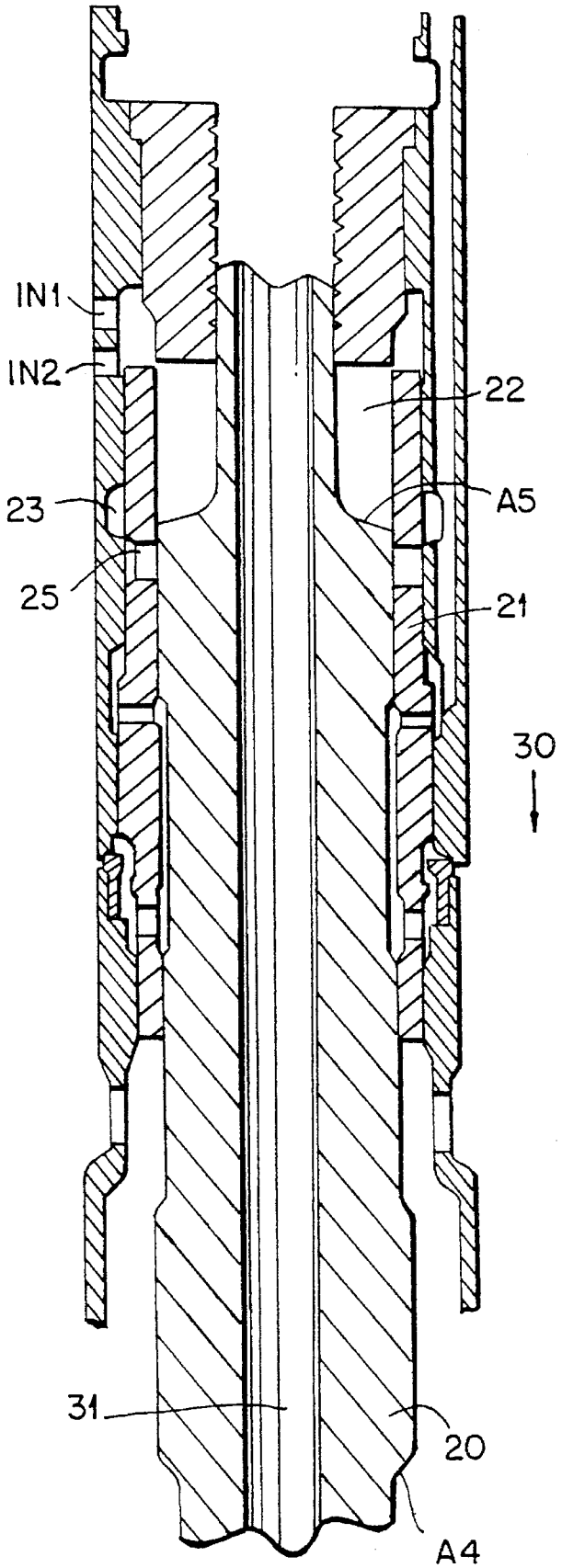

In order to understand the invention, reference will now be made to a preferred embodiment which shall be described with the assistance of drawings in which:

FIG. 1 which illustrates in schematic form one embodiment of the invention,

FIG. 2 illustrates more of the functional details of a drill stem with a down the hole operated liquid hammer motor in accord with the same embodiment, FIG. 3 illustrates a preferred embodiment of the hammer in a first position, FIG. 4 illustrates a preferred embodiment of the hammer in a second position, FIG. 5 illustrates a preferred embodiment of the hammer in a third position, and FIG. 6 illustrates a preferred embodiment of the hammer in a fourth position.

Referring specifically to the drawings, and in particular to FIG. 1, there is illustrated a drill stem 1 located within a hole 2 such that there is an in the hole hammer motor 3 near the end of the drill stem 1 and below this a drill bit 4.

The drill stem 1 is preferably arranged so as to have a central liquid return passage 5, an intermediate liquid supply passage of annular shape 6 and an outermost annular passage defined between the outermost wall of the drill stem and the bore hole at 7. However, the drill stem can be altered such that the flows can be reversed that is the return passage is the intermediate passage of annular shape and the supply passage is the central liquid passage.

The liquid is directed through a pump 9 and through a supply line 8 into the intermediate liquid supply passage 6 at an appropriate pressure to the hammer motor 3. The pressure from the pump 9 can be varied by a by-pass valve to regulte the pressure and flow of the liquid. After the liquid has flown through the hammer motor 3 all or a portion of it is removed from the drill stem 1 along central liquid return passage 5.

In this embodiment the liquid at pressure is directed into the hammer motor 3 after which it flows to the junction 10. The variable flow control valve 16 is adjustably set to provide a means of restricting the flow of the liquid up the central liquid return passage 5. Thereby the variable flow control valve 16 is used to effect the proportion of liquid that flows in the central liquid return passage 5 and the flushing passage 11 to the drill bit. In this example 80% of the volume of water returns back up the central liquid return passage 5 while a remaining 20% passes down the flushing passage 11 to the cutting surface of the drill bit 4 to flush and carry cuttings and samples. The shape of the drill bit 4 is such as to allow the liquid to pass by the drill bit 4 and then return via the outermost annular passage 7 to be collected at an appropriate storage location.

The majority of the liquid (that is 80%) will be returned through the variable flow control valve 16, then through the filter 12 along the return line 19 and into a storage container 13 and this will be preferably kept topped by appropriate access to new water supply from 14 (such as mine water).

Referring FIG. 2, this is substantially the same as illustrated in FIG. 1 except that details at the head 15 of the drill stem 1 show more of the detail of the connections of the liquid supply. Because the drill stem 1 rotates by the effects a further motor in the head 15 there is a rotary swivel 32 for providing a means of connecting the liquid supply and return lines to the rotating drill stem 1.

With reference to FIGS. 3 to 7 the down the hole hammer action is illustrated in detail. As shown in FIG. 3 the hammer piston 20 and sliding valve 21 are in their lowest allowable positions such that the lower end of the hammer (not shown) is in contact with the drill bit. Upon the supplying of pressurised liquid through the inlets IN1, IN2 and IN3 which results in the liquid providing a force at A2 by via the sliding valve opening 24, and pressure is also applied to areas A1 and A3. Accordingly, the force due to the pressure acting upon sum of the areas A1 and A2 is greater than that of the force due to the pressure acting upon area A3 (note the illustration is a cylindrical cross section). Consequently, there is a resultant force providing movement of the sliding valve 21 in the direction of arrow 26. However, the force at due to the pressure acting upon area A4 is less than the force due to the pressure acting upon area A5 and therefore the hammer piston 20 remains in its lowest allowable position.

As shown in FIG. 4 the sliding valve 21 substantially reaches its upper allowable position whilst the hammer piston 20 has remained in its lowest allowable position. In this state the liquid pressure from the inlets IN1 and IN2 is cut off from the chamber 22 and the sliding valve opening 25 is positioned with respect to the liquid return opening 23 so as to form a liquid exit passage. As a result, the liquid pressure in the chamber is lowered and the force due to the pressure acting upon A5 is less than the force due to the pressure acting upon area A4, therefore the hammer piston 20 starts to move in the direction of arrow 26.

When the hammer piston 20 reaches the position as illustrated in FIG. 5 the sliding valve opening 28 is positioned with respect to the liquid return opening 27 so as to form a liquid exit passage for the pressurised liquid contained in the chamber 29. As a result, the force due to the pressure acting upon area A2 is reduced and force due to the pressure acting upon sum of the areas A1 and A2 is less than that of the force due to the pressure acting upon area A3. Consequently, there is a resultant force providing movement of the sliding valve 21 in the direction of arrow 30.

Upon the sliding valve 21 reaching the position as illustrated in FIG. 6 the sliding valve opening 25 is no longer positioned with respect to the liquid return opening 23 so as to form a liquid exit passage. Furthermore, the liquid pressure from the inlets IN1 and IN2 is no longer cut off from the chamber 22 and therefore the pressure is re-applied to the area A5. This results in the force at due to the pressure acting upon A5 being greater than the force due to the pressure acting upon A4 and the hammer piston 20 therefore moves in the direction of arrow 30.

When the sliding valve 21 and hammer piston 20 reach their lowest allowable positions the cycle starts again thereby providing a hammer action to impact a repetitive force upon the drill bit. Preferably, the flushing passage 31 is in communication with the liquid exit passage and therefore there is a flow of liquid along flushing passage 31 to the face of the drill bit. In this embodiment the rate and amount of liquid flow is governed by the sizes of the respective passages and apertures and the flow rate control valve.

Although one form of this invention has been described, it is to be realised that the invention is not to be limited thereto, but can include variations and modifications falling within the scope and spirit of the invention.

I claim:

1. A drilling means including:

a drill stem having a cutting end and a liquid supplying end;

a liquid supply passage in the drill stem;

a liquid return passage in the drill stem;

a drill bit at the cutting end of the drill stem;

a hammer motor located in the drill stem such that its distance from the cutting end is less than its distance from the liquid supplying end, the hammer motor being in mechanical communication with the drill bit such that the hammer motor provides a hammer action to the drill bit, the hammer motor being adapted to provide the hammer action due to pressurised liquid supplied along the liquid supply passage to the hammer motor, the liquid then being returned along the liquid return passage and means for diverting a proportion of said liquid from said liquid supply passage for flushing cuttings at the cutting end of the drill stem.

2. A drilling means as in claim 1 in which the hammer motor has a hammer piston and the location of the hammer motor within the drill stem is such that the hammer piston directly hammers against the drill bit.

3. A drilling means as in claim 1 wherein said diverting means comprises a liquid flushing passage in communication with the liquid return passage for diverting a proportion of the liquid away from the liquid return passage and out of the drill stem at or near the cutting face of the drill bit.

4. A drilling means as in claim 3 wherein said diverting means further comprises an adjustable flow control valve in the liquid return passage, with the adjustable flow control valve being adapted to divert the proportion of liquid away from the liquid return passage to the liquid flushing passage.

5. A drilling means as in claim 3 wherein said diverting means further comprises an adjustable flow control valve located outside of the drill stem in a liquid return line which is in communication with the liquid return passage, wherein the adjustment of the flow control valve varies the flow of liquid along the liquid return passage.

6. A drilling means as defined in claim 1 further comprising:

a liquid storage means for storing liquid; and a pressurising and supplying means for pressurising the liquid and supplying the liquid to the liquid supply passage.

7. A drilling means as in claim 6 in which the hammer motor has a hammer piston and the location of the hammer motor within the drill stem is such that the hammer piston directly hammers against the drill bit.

8. A drilling means as in claim 6 wherein said diverting means comprises a liquid flushing passage in communication with the liquid return passage for diverting a proportion of the liquid away from the liquid return passage and out of the drill stem at or near the cutting face of the drill bit.

9. A drilling arrangement as in claim 8 wherein said diverting means further comprises an adjustable flow control valve in the liquid return passage, with the adjustable flow control valve being adapted to divert the proportion of liquid away from the liquid return passage to the liquid flushing passage.

10. A drilling arrangement as in claim 8 wherein said diverting means further comprises an adjustable flow control valve located outside of the drill stem in a liquid return line which is in communication with the liquid return passage, wherein the adjustment flow control valve is adapted to vary the flow of liquid along the liquid return passage.

11. A method of drilling including the steps of:

supplying a pressurised liquid down a drill stem to a hammer motor located within the drill stem;

providing a hammer action resulting from the effects of the supplying of the pressurised liquid to the hammer motor;

effecting a drilling action of a drill bit located at the drilling end of the drill bit, the drilling action resulting from the hammer action;

directing the liquid supplied to the hammer motor up the drill stem through a return passage in the drill stem and diverting a proportion of the liquid away from the return passage and to the face of the drill bit.

12. A method of drilling as in claim 11 further characterised by step of effecting of the drilling action being the result of the hammer motor hammering against the drill bit.

13. A method of drilling as in claim 12 further characterised by the drilling being in a substantially downward direction such that the drill bit is physically below the hammer motor and the rest of the drill stem.

14. A method of drilling as in claim 11 in which the step of diverting is further characterised in that the proportion diverted is less than the proportion flowing along the return passage.

15. A method of drilling as in claim 14 in which the diverting step is further characterised by approximately 20% of the liquid is diverted to the face of the drill bit.

* * * * *